US009085438B2

(12) United States Patent
Wilkins et al.

(10) Patent No.: US 9,085,438 B2
(45) Date of Patent: Jul. 21, 2015

(54) ROLL HOLDER WITH INTERNAL FRAGRANCE DISPENSER

(75) Inventors: YaVaughnie Wilkins, Santa Monica, CA (US); Anthony Montoya, Santa Monica, CA (US)

(73) Assignee: FOLLOW THRU, LLC, Santa Monica, CA (US)

( * ) Notice: Subject to any disclaimer, the term of this patent is extended or adjusted under 35 U.S.C. 154(b) by 470 days.

(21) Appl. No.: 13/216,075

(22) Filed: Aug. 23, 2011

(65) Prior Publication Data

US 2012/0097790 A1 Apr. 26, 2012

Related U.S. Application Data

(60) Provisional application No. 61/376,138, filed on Aug. 23, 2010, provisional application No. 61/391,023, filed on Oct. 7, 2010.

(51) Int. Cl.

| | |
|---|---|
| ***B65H 16/06*** | (2006.01) |
| ***B65H 18/04*** | (2006.01) |
| ***B65H 49/26*** | (2006.01) |
| ***B65H 49/32*** | (2006.01) |
| ***B65H 75/18*** | (2006.01) |
| ***B65H 75/08*** | (2006.01) |
| ***A47K 10/38*** | (2006.01) |
| *A47K 10/32* | (2006.01) |

(52) U.S. Cl.

CPC ..... *B65H 75/08* (2013.01); *A47K 10/38* (2013.01); *A47K 2010/322* (2013.01); *B65H 2701/522* (2013.01)

(58) Field of Classification Search

USPC ..... 242/599, 599.2, 599.4, 597.5, 613, 242/613.1, 598, 598.3, 599.1, 599.3, 905; 239/52

See application file for complete search history.

(56) References Cited

U.S. PATENT DOCUMENTS

| | | | | |
|---|---|---|---|---|
| 1,552,082 | A | 9/1925 | Riley | |
| 2,546,820 | A * | 3/1951 | Grant | 242/599.1 |
| 2,639,939 | A | 5/1953 | Matchett | |
| 2,988,283 | A | 6/1961 | Garfield | |
| 4,191,342 | A | 3/1980 | Reinhold | |
| 4,447,015 | A | 5/1984 | Peterson | |
| 4,759,510 | A | 7/1988 | Singer | |
| 4,957,246 | A | 9/1990 | Kantor | |
| 5,170,938 | A | 12/1992 | Dewing | |
| D347,470 | S | 5/1994 | Kehrberger | |
| 5,494,218 | A | 2/1996 | Armand | |
| 5,857,621 | A | 1/1999 | Poulus | |
| 6,969,024 | B2 * | 11/2005 | He et al. | 242/599 |
| 2005/0098465 | A1 * | 5/2005 | Wolf | 206/410 |
| 2008/0001020 | A1 | 1/2008 | Burnett | |
| 2009/0001213 | A1 | 1/2009 | Looft | |
| 2010/0140372 | A1 | 6/2010 | Patrick | |

OTHER PUBLICATIONS

International Search Report and Written Opinion dated Feb. 2, 2012.

* cited by examiner

*Primary Examiner* — Emmanuel M Marcelo
*Assistant Examiner* — Angela Caligiuri
(74) *Attorney, Agent, or Firm* — Jonathan Jaech; Snell & Wilmer L.L.P.

(57) ABSTRACT

A tissue roll holder includes an interior ventilated chamber holding potpourri or other scented products, a spring-loaded spindle and spacers for holding the interior surface of a tissue roll spaced apart from the chamber.

20 Claims, 7 Drawing Sheets

Fig. 6A
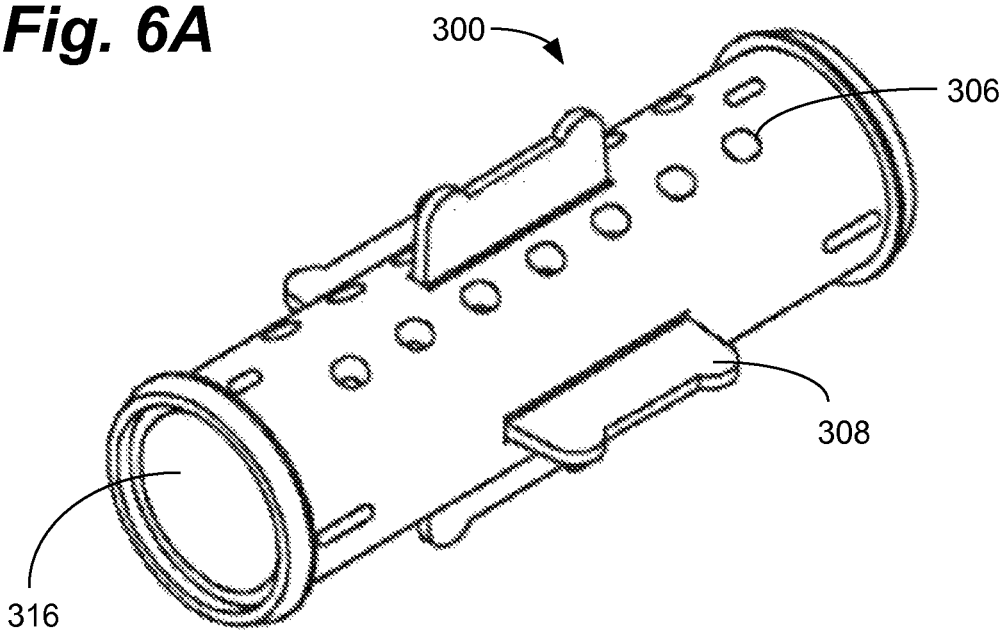
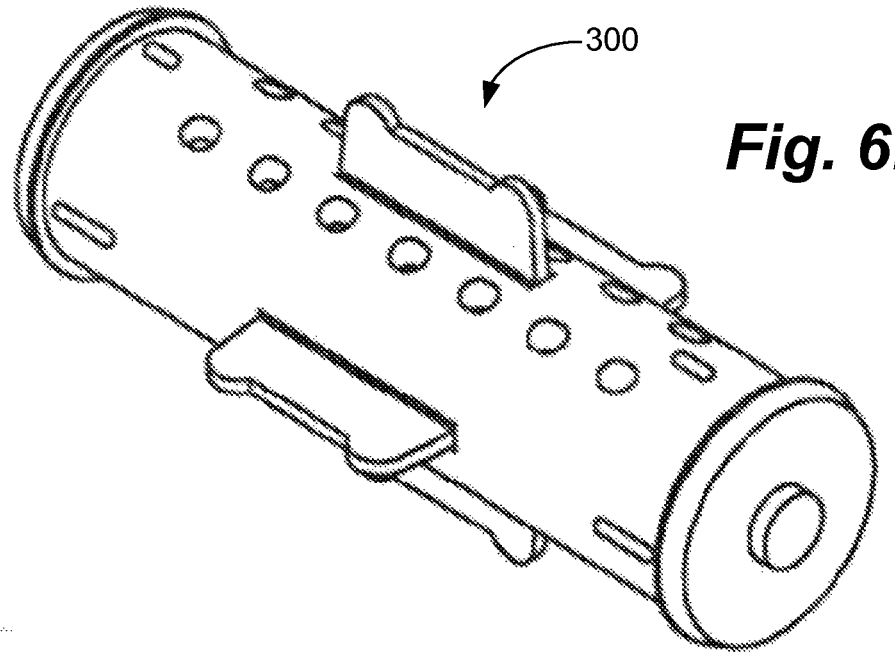
Fig. 6B

Fig. 12
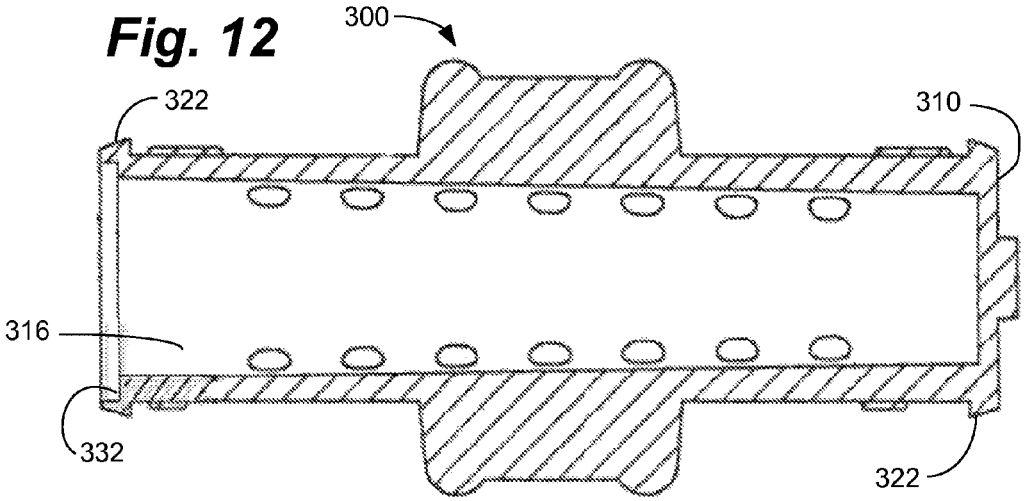
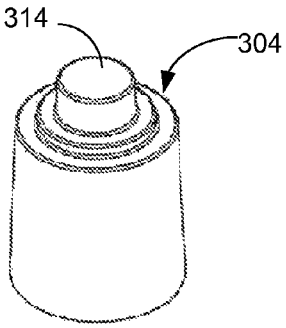
Fig. 13A
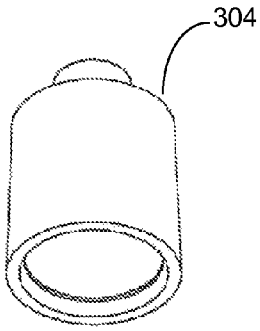
Fig. 13B
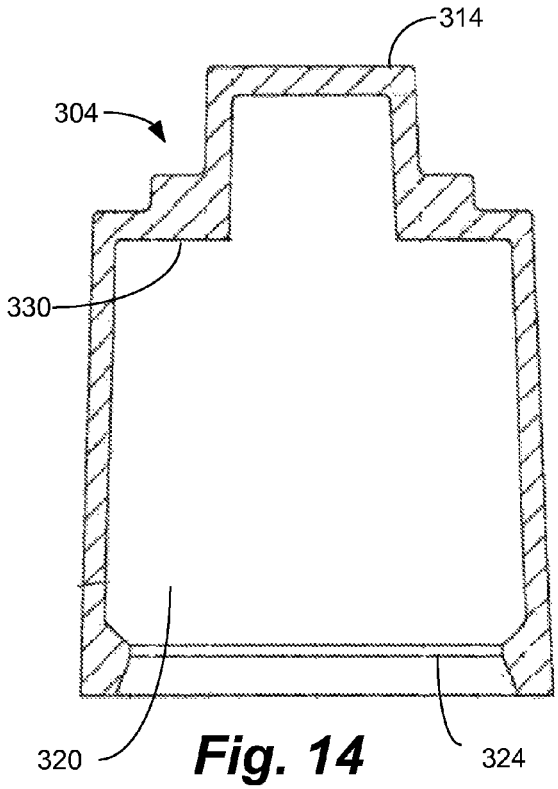
Fig. 14

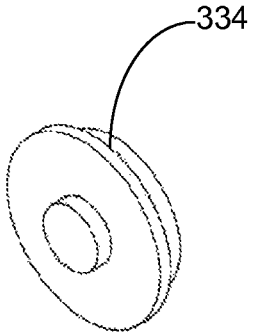
Fig. 15A
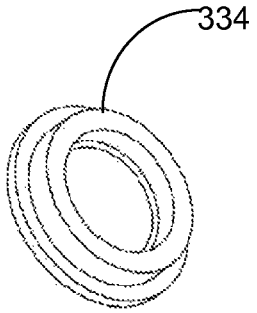
Fig. 15B
Fig. 16
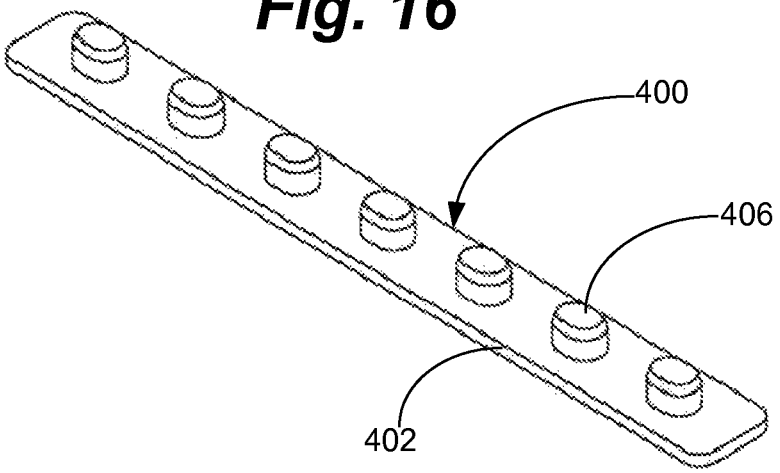

ROLL HOLDER WITH INTERNAL FRAGRANCE DISPENSER

CROSS-REFERENCE TO RELATED APPLICATION

This application claims priority pursuant to 35 U.S.C. §119 (e) to U.S. provisional application Ser. No. 61/376,138, filed Aug. 23, 2010, and to U.S. provisional application Ser. No. 61/391,023, filed Oct. 7, 2010, which applications are hereby incorporated by reference in their entireties.

BACKGROUND

1. Field

The present disclosure relates to an apparatus for holding tissue paper rolls, which includes features for dispensing a fragrance.

2. Description of Related Art

Bathrooms commonly include structures for holding a toilet tissue roll within reach of each toilet. Such structures include roll holders, which are available in various styles. Tissue paper rolls are often proved with a generally cylindrical tubular core or support tube around which the tissue paper is rolled. One commonly used style comprises a telescoping cylindrical spindle for inserting through the core of the tissue roll. The cylindrical tube may be equipped with an internal compression spring to maintain the spindle at the limits of its telescoping action. The spindle can be compressed to fit horizontally between opposing arms or walls of a roll holding structure. The compression spring maintains the spindle securely in compression against the roll holding structure, while permitting horizontal rotation of the tissue for dispensing tissue therefrom. An alternative style, also commonly seen in households, comprises a horizontally disposed arm for insertion through the central support tube of the tissue roll. Notwithstanding the ubiquity of these and other styles of tissue roll holders, such holders are seldom used for functions other than their primary function of holding a tissue for convenient dispensing.

Another common feature found in bathrooms is the fragrance dispenser. Fragrance dispensers also come in various styles, including various dispensers of volatile solids and liquids, as well as the traditional potpourri holder. As compared to chemical odorants, potpourri provides the advantage of a more subtle natural aroma that is less likely to cause irritation or allergic reactions in sensitive individuals. However, from a housekeeping perspective, potpourri may be more difficult to manage than chemical odorant dispensers, particularly in households with young children or pets.

It would be desirable, therefore, to provide these and other benefits of useful bathroom products such as exemplified above in an aesthetically pleasing, convenient, and cost-effective product.

SUMMARY

A roll holder for holding paper roll products is provided, comprising a tubular spindle closed at both ends thereof to provide a chamber therebetween in an interior of the spindle, for insertion through a core of a paper roll product. The chamber may be in fluid communication with an exterior of the spindle via a plurality of openings, for example, circular holes or clots passing through the chamber walls. The spindle may be generally cylindrical in shape. Its interior chamber may also be generally cylindrical.

The interior chamber is configured to hold a scented product. Any suitable solid scented product may be disposed in the chamber. For example, a potpourri material may be disposed in the chamber. The potpourri may be loosely packed in the chamber to enable tumbling of the potpourri in response to rotation of the spindle around its longitudinal axis. Such tumbling may enhance release of fragrance from the potpourri as paper is dispensed from the roll holder. In the alternative, the potpourri may be tightly packed in the chamber to prevent tumbling of the potpourri despite rotation of the spindle around its longitudinal axis.

The roll holder may further comprise a cover piece closing at least one end of the chamber. The cover piece may be configured to be not removable from the spindle, sealing the scented product in the chamber. In this configuration, the roll holder is intended to be disposed of when the scented product loses its fragrance. In the alternative, the cover piece may be removably attached to the spindle, to enable replacement of the scented product and re-use of the roll holder with renewed scented product placed therein.

In another aspect, the roll holder may further comprise a plurality of stand-offs fixed to the spindle around an outer periphery thereof, configured to hold an interior surface of a cylinder (e.g., a paper roll core) in a spaced-apart relation to the spindle. For example, the stand-offs may comprise a plurality of contoured fins or ribs arranged symmetrically around the periphery of the spindle, for holding the core of the paper roll. For further example, the plurality of stand-offs may be configured to hold the interior surface of the cylinder spaced at least 0.1 or 0.25 inches from a cylindrical exterior surface of the spindle.

In another aspect, the roll holder may further comprise a terminal piece moveably attached to at least one end of the spindle, configured to permit temporary compression of opposing terminals of the spindle along a longitudinal axis thereof, thereby enabling insertion of the spindle into fixed receivers for the opposing terminals. The roll holder may further comprise a compression spring disposed between the spindle and the terminal piece, to urge the terminal piece outward along the longitudinal axis. Outward movement of the terminal piece may be restrained by a latch member attaching the terminal piece to the spindle. The roll holder may be equipped with a second terminal piece moveably attached to an end of the spindle opposite to the first terminal piece. Likewise, a second compression spring may be disposed between the spindle and the second terminal piece, to urge the second terminal piece outward along the longitudinal axis; and outward movement of the second terminal piece may be restrained by a second latch member attaching the second terminal piece to the spindle.

The terminal piece or pieces may each be configured as a cap covering at least one end of the spindle. The cap may be attached to an axle portion protruding from the cap along the longitudinal axis, distal from the spindle. The axle portion may be configured to fit into a receiver for a support arm or support plate for holding the spindle in a horizontal position will remaining free to turn.

The roll holder may be configured to fit snugly into the cylindrical core of the tissue paper. Thus, as the tissue paper is pulled from the roll, the core and roll holder rotate together. The rotation of the roll hold may cause or enhance release or fragrance from the scented product in the interior chamber. For example, rotation may cause increased turbulent air flow, tumbling of the scented product, or both, thereby increasing the rate at which fragrance is released.

In other embodiments, the roll holder may be configured as a cylindrical member with a central cylindrical passage from end to end, causing the interior chamber to have an annular cross section. In these embodiments, the terminal pieces may be omitted and the roll holder mounted by inserting a rod-shaped member through the central cylindrical passage.

A more complete understanding of the roll holder with internal fragrance dispenser will be afforded to those skilled in the art, as well as a realization of additional advantages and objects thereof, by a consideration of the following detailed description. Reference will be made to the appended sheets of drawings which will first be described briefly.

BRIEF DESCRIPTION OF THE DRAWINGS

FIGS. 6A-B are perspective views of a spindle of a roll holder, according to an alternative embodiment.

FIG. 12 is an cross-sectional view of the spindle shown in FIGS. 6A-B, through the section B-B shown in FIG. 7 and slightly enlarged.

FIGS. 13A-B are perspective views of a terminal piece for assembling onto opposite ends of the spindle shown in FIGS. 6A-B to form a roll holder.

FIG. 14 is an cross-sectional view of the terminal piece shown in FIGS. 13A-B, enlarged in scale relative to FIGS. 13A-B.

FIGS. 15A-B are perspective views of an end cap for sealing the interior of the spindle shown in FIGS. 6A-B an one end thereof.

FIG. 16 is a perspective view of a plug strip for temporarily closing ventilation openings in a spindle prior to installation of the roll holder.

Throughout the drawings and detailed description, like element numerals are used to refer to like elements depicted in the drawings.

DETAILED DESCRIPTION

Figure 1:
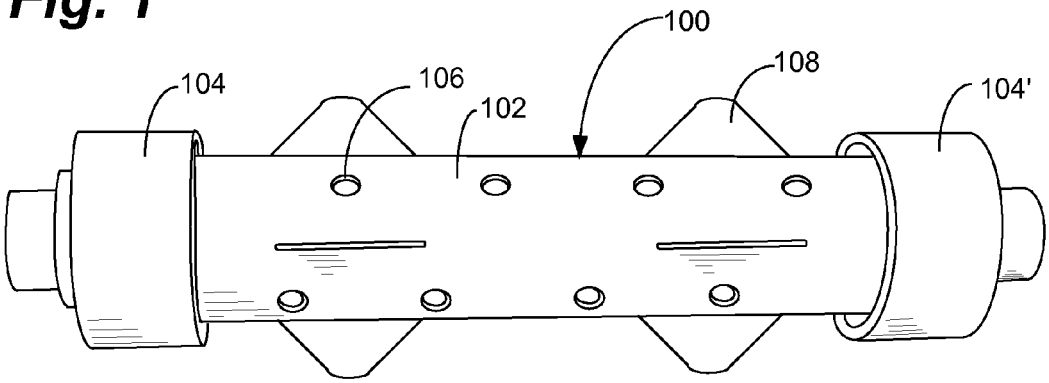
FIG. 1 is a side view of a roll holder with internal fragrance dispenser, illustrating by way of example its novel aspects and features.
Figure 2:
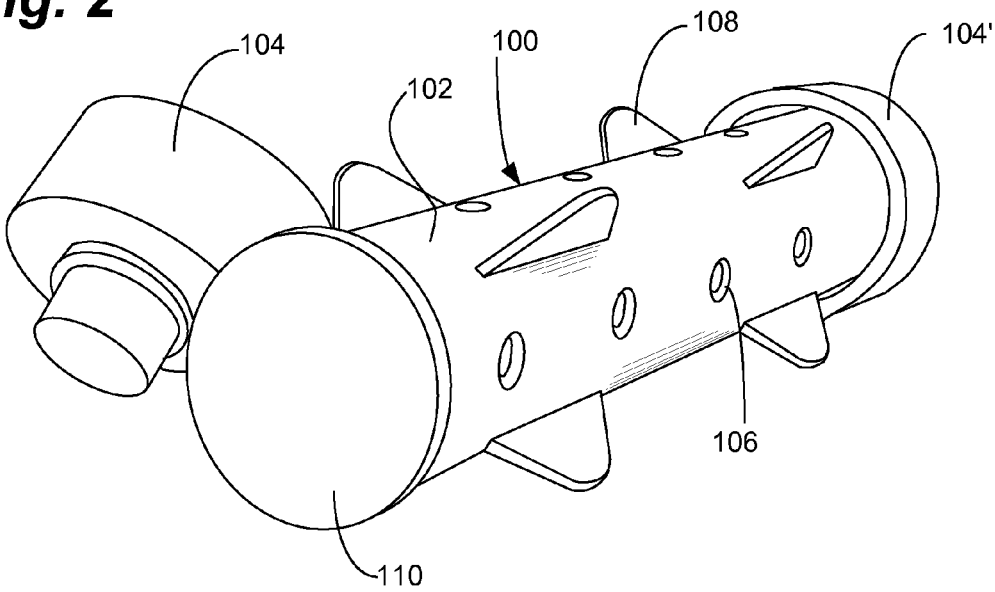
FIG. 2 is a perspective view of the roll holder, with a terminal piece removed to reveal an end cap for an interior fragrance chamber.
Figure 3:
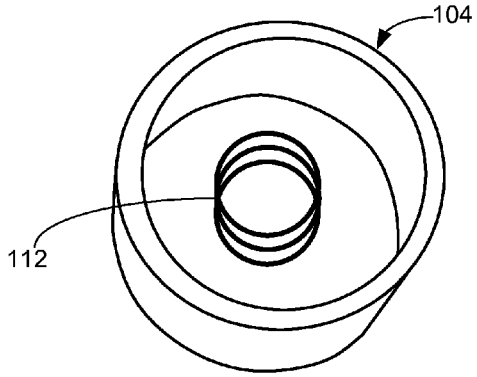
FIG. 3 is a perspective view of a terminal piece removed from the roll holder, showing an internal compression spring.
Figure 4:
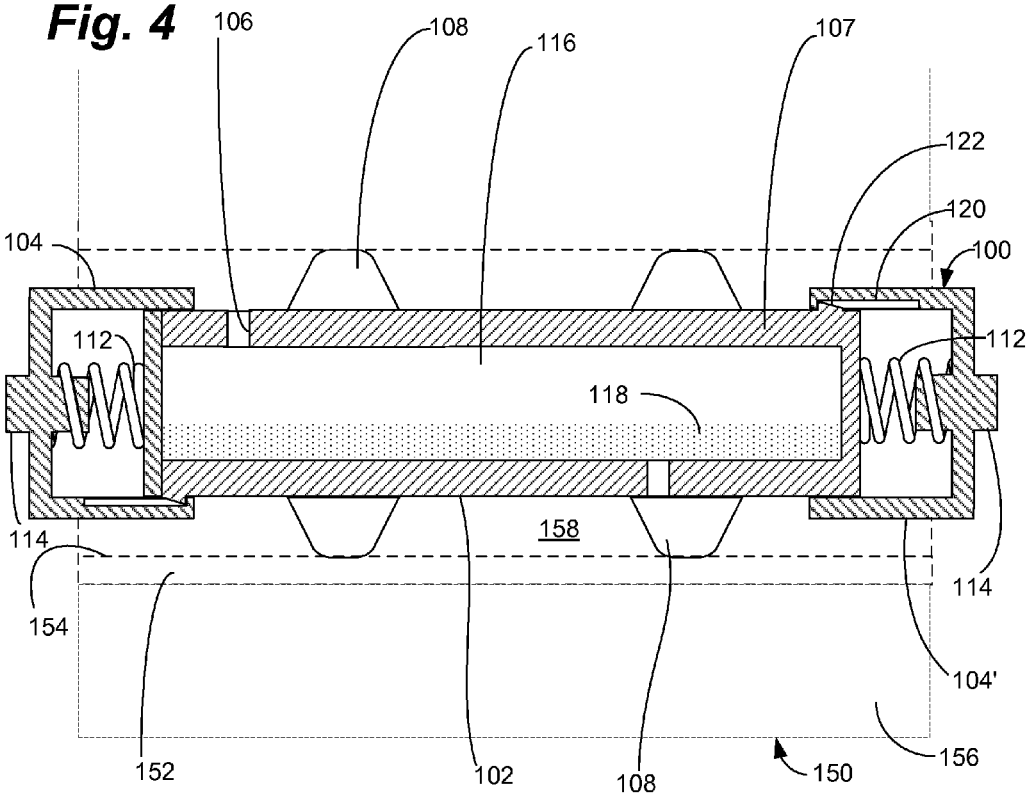
FIG. 4 is a cross-sectional assembly view of the roll holder.

FIGS. 1-4 depict an example of a roll holder 100 in various views. The roll holder 100 comprises a tubular spindle 102 made of any durable structural material, for example, a structural plastic or metal material formed by any suitable process. The spindle 102 includes an interior chamber or cavity 116 (FIG. 4) that is substantially enclosed. In some embodiments as depicted, the chamber is free of any internal spring and is formed in the spindle 102 consisting of a single unitary section. In the alternative, the spindle may be formed from two or more nested sections assembled together to provide a chamber within, and may be expandable or compressible under the action of a compression spring placed inside such chamber.

The chamber 116 is provided with a plurality of through holes 106 or equivalent openings passing through the chamber walls 107. The openings 106 admit ambient air into the interior of the chamber 116 and permit fragrance to be provided from the interior of the chamber to the ambient environment. For example, aromatic fragrances may be released through the openings 106 into an air gap 158 formed between the spindle 102 and the inside surface 154 of a core 152 for a tissue roll product 150 held by the spindle. From the air gap 158, the fragrance may diffuse into the ambient environment.

A fragrant product 118 is disposed in an interior of the chamber 116. The fragrant product may comprise, for example, a loose, generally particulate solid product, for example, a potpourri made from natural materials, or porous beads (e.g. wooden beads) saturated with fragrant oil. In embodiments where the fragrant product is a particulate material, each opening 106 should be smaller than the minimum particle size for the fragrant product, in at least one dimension. For example, if the openings are circular through holes, the hole diameter should be less than the minimum particle diameter. A particulate or beaded fragrant product 118 may be loosely packed so that it tumbles within the chamber 116 in response to rotation of the spindle 102. Tumbling of the product 118 may enhance air flow and release of fragrance from the product. Thus, the rate of release of fragrance may temporarily increase when the spindle is rotated, for example, as paper 156 is drawn off a roll of tissue paper 150 supported by the spindle 102. In the alternative, the particulate fragrant product may be tightly packed in the chamber 116, so that it does not tumble and remains in place even while the spindle is rotated.

The chamber may be closed using an end cap 110 after the fragrant product is placed in its interior. In some embodiments, the end cap 110 is permanently fixed to the end of the spindle 102, sealing the fragrant product inside. In other embodiments, the end cap may be removable, for example, using a threaded surface, to permit removal and replacement of the fragrant product at any desired time after initial assembly.

In the alternative, or in addition, the fragrant product may comprise a substantially solid material, for example, a gel, paste or wick infused with volatile and semi-volatile fragrances. In these embodiments, the openings 106 should be small enough to protect the fragrant product from damage and large enough to admit air for wafting fragrance from the chamber 116. A non-particulate solid fragrance may be supported by a surface or frame (not shown) in the interior of the chamber 116. In alternative embodiments, the chamber 116 may be sealed and hold a liquid fragrance, such as a fragrant oil. In such embodiments, aromatic fragrance may be transported to the exterior of the spindle 102 using one or more wicks (not shown) passing through the chamber walls 107 and into the air gap 158 formed between the spindle 102 and the inside surface 154 of a core 152 for a tissue roll product 150.

The roll holder 100 may further comprise one or more stand-offs 108 or spacers disposed on and fixed to an exterior wall of the spindle 102. The stand-offs may be co-molded with the spindle 102, or formed in any other suitable fashion. The stand-offs 108 may be configured such that, when the roll holder 100 is inserted in into the core 152 of a paper roll 150, the stand-offs operate to center the spindle in the interior of the paper core 152, and provide an annular gap 158 between the exterior wall of the spindle 102 and the paper core 152. In the United States, consumer toilet tissue roll cores may be generally cylindrical, about 4.5 inches long and may have an inner diameter in the range of about 1.55 to 1.70 inches; for example, about 1.60 inches. The roll holder may be constructed to fit this size, or other standard core sizes. The roll holder is configured such that the annular gap 152 is in fluid communication with the ambient air environment at both ends of the roll holder, to enhance discharge of fragrance from the chamber 116 through the air gap 152 into the environment. For example, an annular gap having an average height in the range of about 0.1 to 0.5 inches may be suitable; for further example, a gap of about 0.36 inches. In addition, the stand-offs may be configured to fit snugly against the interior surfaces of 154 of the paper core 152, such that drawing paper 156 off of the core causes the spindle 102 to rotate with the core 152. The stand-offs 108 may be contoured as shown to facilitate insertion and removal of the roll holder 100 from the paper core 152.

The roll holder 100 may further comprise one or two terminal pieces 104, 104'. In the depicted embodiment, both terminal pieces comprise separate parts free to slide relative to the spindle 102 in the direction of its longitudinal (i.e., cylindrical) axis. Each terminal piece is forced outward by an internally-disposed compression spring 112 and held in place by a stop 122, which may be accommodated in a slot 120. Each terminal piece may be provided with a centrally-disposed axle portion 114 to provide a bearing surface for a support arm or support wall. In the alternative, the roll holder 100 may comprise a single terminal piece 104, while the opposite end of the spindle may lack a separate moveable terminal piece and instead be configured with a fixed integral terminal surface for placing in a complementary receiver. The terminal piece or pieces 104, 104' may be configured to permit temporary compression of the opposing terminals of the spindle along a longitudinal axis thereof, thereby enabling insertion of the spindle 102 into fixed receivers for the opposing terminals. Such fixed receivers may be configured to hold the spindle 102 and any paper roll 150 into which the spindle is inserted, while permitting rotation of the roll 150 and spindle 102 as paper is drawn off the roll.

Figure 5:
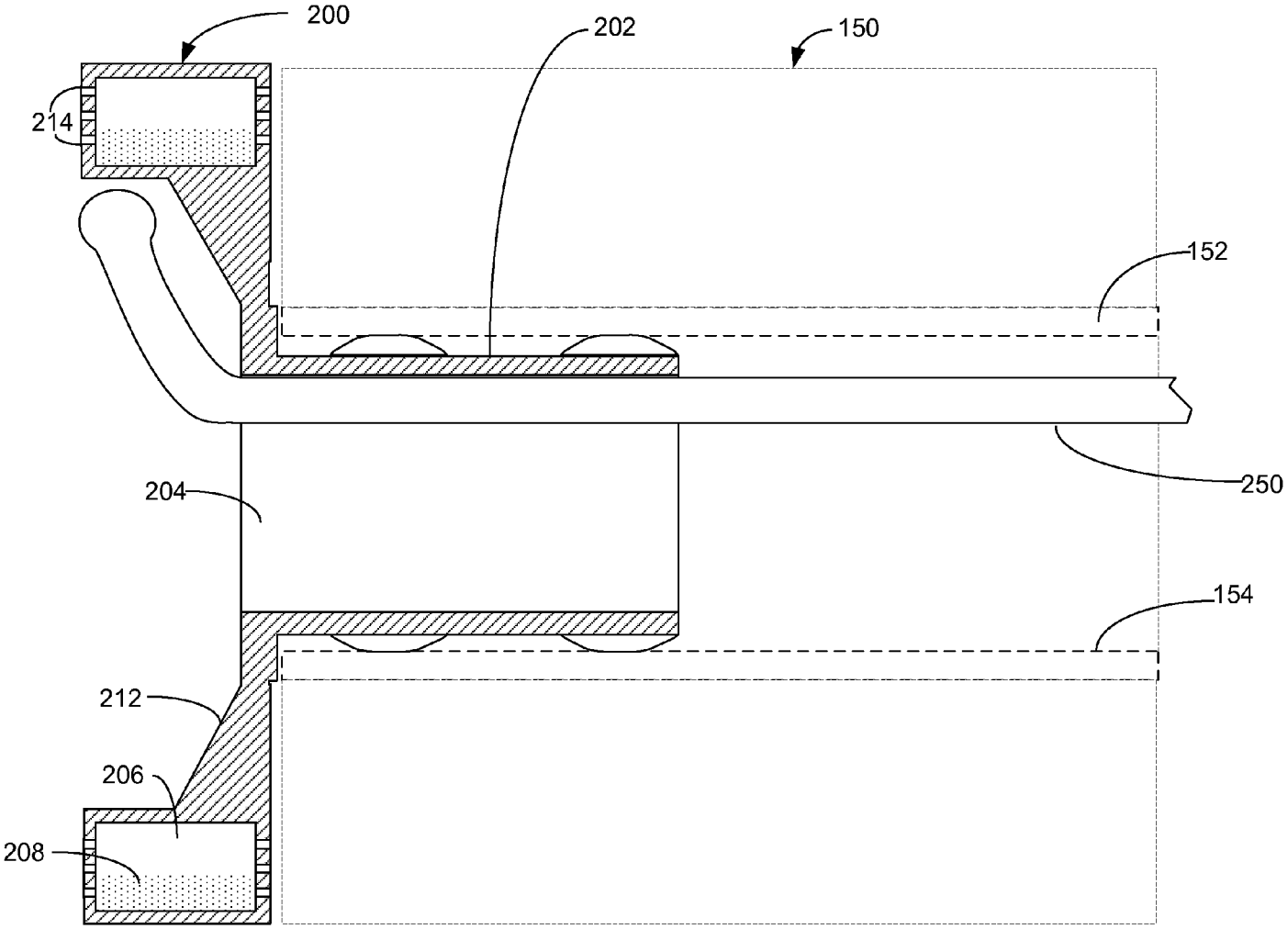
FIG. 5 is a cross-sectional view of an alternative roll holder for use with a rod-type of mounting system.
Figure 7:
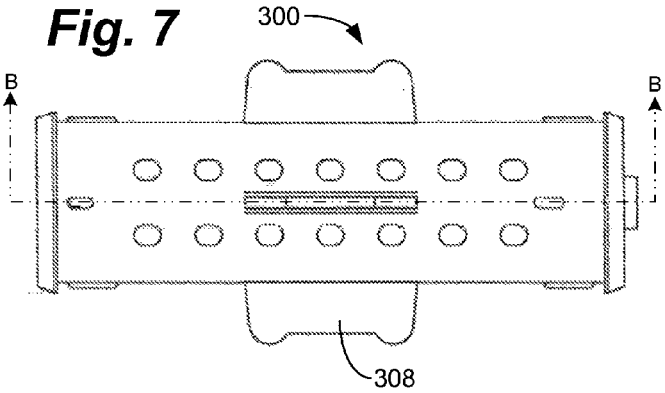
FIG. 7 is a top (plan) view of the spindle shown in FIGS. 6A-B.
Figure 8:
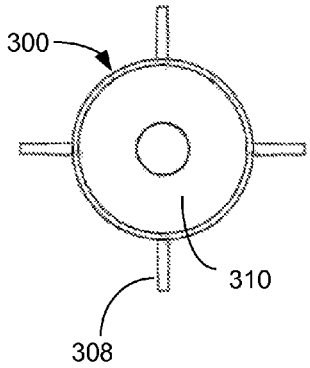
FIG. 8 is a right end view of the spindle shown in FIGS. 6A-B.
Figure 10:
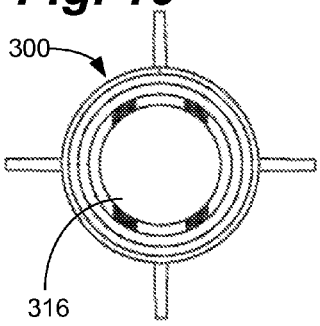
FIG. 10 is a left end view of the spindle shown in FIGS. 6A-B.
Figure 9:
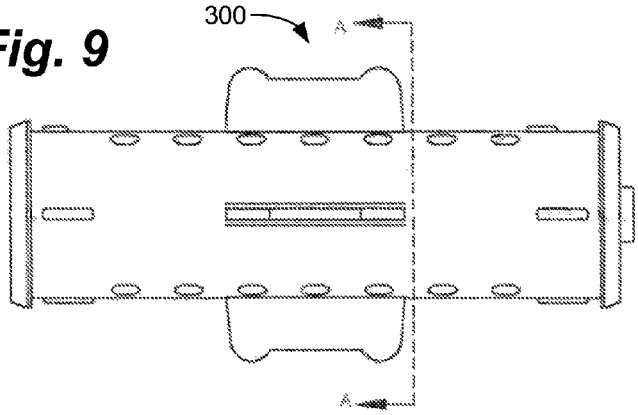
FIG. 9 is a side view of the spindle shown in FIGS. 6A-B.

An alternative fragrance dispenser 200 is shown in FIG. 5, for use with roll-holding structures that rely in a cantilevered rod 250 or arm to support a tissue roll 150. The fragrance dispenser 200 may be configured to fit snugly into the paper core 152 using friction between the tubular base 202 and the inner core surface 154 to lock the dispenser 200 to the core. The dispenser may include an integral tubular base 202 having a through channel or passage 204 sufficiently large in diameter to permit full insertion of the cantilever arm 250 through the dispenser. The dispenser may include an annular chamber 206 formed in an end piece 212 attached to the support tube or base 202, provided with ventilation openings 214. A fragrant product 208 may be disposed in the chamber 206 as described above for the roll holder 100. Rotation of the roll 150 and dispenser 200 may enhance release of fragrance from the dispenser because of tumbling of the fragrant product in the chamber 206, increased air movement, or other action.

Figure 11:
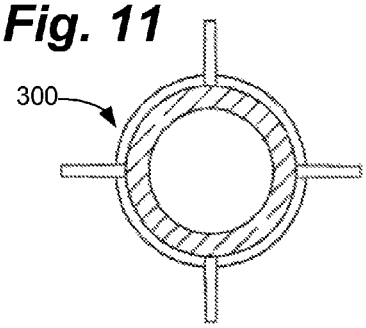
FIG. 11 is a cross-sectional view of the spindle shown in FIGS. 6A-B, through the section A-A shown in FIG. 9.

FIGS. 6A-12 show various views of a tubular spindle of a roll holder, according to an alternative embodiment. Referring to FIGS. 6A-B and 7-12, the spindle 300 may be formed of any suitable durable material, for example a thermoplastic or thermoset moldable polymer. The spindle 300 may include an interior compartment 316 for holding a fragrant product as described elsewhere herein. The interior compartment 316 may be generally cylindrical, and the tubular spindle 300 may have a circular cross-section, as shown in FIG. 11. Other cross-sectional shapes, for example, square or triangular, may also be used. The tubular wall of the spindle 300 may include a plurality of openings 306 for allowing fragrance to be wafted from a fragrant product located in the interior chamber to an exterior of the spindle. The openings 306 should be sized to retain a solid fragrant product completely inside the interior chamber 316, while freely admitting air to waft away fragrance evaporating from the solid product. The fragrant product retained in the interior of the chamber 316 may include, for example, porous beads, strands, shredded paper, entangled pulp or pellets having a known minimum diameter and infused with a fragrant oil or other scented liquid. In the alternative, the fragrant product may comprise a potpourri of naturally fragrant materials that is screened to reduce or eliminate the presence of particles less than a defined minimum diameter. In either case, the openings may be sized slightly smaller than a defined minimum diameter of the enclosed product.

For a tubular spindle of circular cross section, stand-offs 308 may be arranged around an outer perimeter of the spindle, as shown in FIGS. 6A-11. In the depicted embodiment, the spindle 300 includes four contoured stand-offs 308 disposed in a circularly symmetrical pattern and centered along the length of the spindle 300. Centering the stand-offs 308 may provide the advantage of removing obstructions from the distal ends of the spindle 300, that might otherwise tend to obstruct fluid communication between the spindle-core gap and an exterior of the core. The stand-offs 308 may be fixed to the spindle around an outer periphery thereof, and may be configured to hold an interior surface of a cylinder in a spaced-apart relation to the spindle thereby providing the gap facilitating fluid communication between the chamber and an exterior of the cylinder. For example, the standoffs may be circularly symmetric around a cylindrical axis of the spindle 300, to provide an annular gap when inserted into the cylindrical core of a tissue roll. The annular gap should be sufficiently large to permit fluid communication between the chamber 316 and an exterior of the tissue roll core. For example, a gap having an average height in the range of about 0.1 to 0.5 inches may be suitable for a roll holder for use with consumer toilet tissue rolls, and more preferably in the range of about 0.25 to 0.4 inches. A great variety of other stand-off shapes and locations may also be suitable. For example, stand-offs may be configured as an part of the tubular geometry of the spindle, instead of as contoured fins 308, in the case of a tubular spindle having a polygonal cross section. In such spindles, corners of the polygonal cross-section may function as stand-offs to provide a space between the sides of the tubular spindle and an inner cylindrical surface of a tissue roll core.

FIGS. 13A-B and 14 show various views of a terminal piece 304 for assembling onto opposite ends of the spindle 300 near the flanges 322 form a roll holder. A compression spring (not shown) may be assembled in the spring chamber 320 between a bearing surface 330 and an opposing surface 310 of the spindle 300, similarly to the assembly 100 shown in FIG. 4. An interior lip 324 may be fitted over an opposing flange 322 to lock the terminal piece onto the spindle while permitting compression and movement of the terminal piece along a longitudinal axis of the tubular spindle 300. Such movement may facilitate insertion of an assembled roll holder between fixed receivers of a roll retention fixture as commonly used in bathrooms. A protruding cylindrical post 314 at a distal end of the terminal piece 304, also called an axle portion, may be used to retain an assembled roll holder in one or more recesses of such fixtures.

An end cap 334 as shown in FIGS. 15A-B may be used for sealing the interior 316 of the spindle 300. The end cap 334 may be assembled into a recess 332 at one end of the spindle 300, shown in FIG. 12. A plug strip 400 as shown in FIG. 16 may be used for temporarily closing ventilation openings 306 in a spindle 300 prior to installation and end use of the roll holder. The plug strip 400 may be formed of a soft elastomeric material and may include a plurality of spaced-apart plugs 406 joined along a base strip 402. Each of the plugs 406 may be shaped to plug a corresponding opening 306 of the spindle 300, while being removable with moderate force by pulling the base strip away from the spindle. Thus, fragrance may be sealed inside the spindle without appreciable loss until the roll holder is put into use.

Having thus described a preferred embodiment of a roll holder with internal fragrance dispenser, it should be apparent to those skilled in the art that certain advantages of the within system have been achieved. It should also be appreciated that various modifications, adaptations, and alternative embodiments thereof may be made without departing from the scope and spirit of the present technology. For example, a generally cylindrical roll holder has been illustrated, but it should be apparent that the novel concepts described above may be applied by one of ordinary skill to spindles of other cross sectional shapes to thereby realize the unexpected benefits described herein. For example, a tubular spindle having a triangular, square, pentagonal, hexagonal, rectangular or other polygonal cross-sectional shape may be used. Likewise, standoffs for providing a space between the spindle outer perimeter and the inner surface of a tissue roll may be provided in various shapes and locations. The standoffs may be incorporated into the geometry of the spindle itself; for example, the corners of a tubular spindle having a triangular cross-section may serve as stand-offs for holding the inner tube of a tissue roll, while providing a ventilation space between the sides of the triangular spindle and the tube wall. The scope of what is claimed should be determined by the appended claims interpreted in accordance with the foregoing specification, and is not limited by the examples hereinabove.

What is claimed is:

1. A roll holder for holding roll products, comprising:

a tubular spindle closed at both ends thereof to provide a chamber therebetween in an interior of the spindle, the chamber being in fluid communication with an exterior of the spindle via a plurality of openings;

a plurality of stand-offs fixed to the spindle around and oriented radially outward from an outermost cylindrical surface of the spindle, configured to fit snugly against and hold an interior surface of a cylindrical tissue roll core not less than about 1.55 inches in diameter in a spaced-apart relation to the spindle with an annular gap all around the outermost cylindrical surface of the spindle and between the outermost cylindrical surface of the spindle and the interior surface of the cylindrical tissue roll core, the annular gap facilitating fluid communication between the chamber and an exterior of the cylindrical tissue roll core, wherein the plurality of stand-offs comprise generally rectangular fins arranged symmetrically around the periphery of the spindle and centered along the length of the spindle, each of generally rectangular fins having a pair of rounded ears at corners distal from the spindle wherein one of each pair is positioned at opposite ones of the corners and protrudes outward beyond a long edge of the each of generally rectangular fins distal from the spindle; and a terminal piece moveably attached to at least one end of the spindle, configured to permit temporary compression of opposing terminals of the spindle along a longitudinal axis thereof, thereby enabling insertion of the spindle into fixed receivers for the opposing terminals.

2. The roll holder of claim 1, wherein the spindle is generally cylindrical.

3. The roll holder of claim 1, further comprising a scented product disposed in the chamber.

4. The roll holder of claim 3, wherein the scented product comprises a potpourri.

5. The roll holder of claim 4, wherein the potpourri is loosely packed in the chamber to enable tumbling of the potpourri in response to rotation of the spindle around its longitudinal axis.

6. The roll holder of claim 4, wherein the potpourri comprises scented beads.

7. The roll holder of claim 1, wherein the plurality of openings comprise circular holes.

8. The roll holder of claim 1, wherein each of the generally rectangular fins has a length parallel to a long axis of the spindle that is less than ⅓ of a length of the spindle along the long axis.

9. The roll holder of claim 1, wherein the chamber is generally cylindrical.

10. The roll holder of claim 1, further comprising a cover piece closing at least one end of the chamber.

11. The roll holder of claim 10, wherein the cover piece is not removable from the spindle.

12. The roll holder of claim 10, wherein the cover piece is removably attached to the spindle.

13. The roll holder of claim 1, wherein the plurality of stand-offs are configured to hold the interior surface of the cylindrical tissue roll core spaced at least 0.1 inches from the outermost cylindrical surface of the spindle.

14. The roll holder of claim 1, wherein the plurality of stand-offs are configured to hold the interior surface of the cylindrical tissue roll core spaced at least 0.25 inches from the outermost cylindrical surface of the spindle.

15. The roll holder of claim 1, further comprising a compression spring disposed between the spindle and the terminal piece, urging the terminal piece outward along the longitudinal axis.

16. The roll holder of claim 15, wherein outward movement of the terminal piece is restrained by a latch member attaching the terminal piece to the spindle.

17. The roll holder of claim 1, further comprising a second terminal piece moveably attached to an end of the spindle opposite to the terminal piece.

18. The roll holder of claim 17, further comprising a second compression spring disposed between the spindle and the second terminal piece, urging the second terminal piece outward along the longitudinal axis.

19. The roll holder of claim 18, wherein outward movement of the second terminal piece is restrained by a second latch member attaching the second terminal piece to the spindle.

20. The roll holder of claim 1, wherein the terminal piece is configured as a cap covering the at least one end of the spindle, comprising an axle portion protruding from the cap along the longitudinal axis distal from the spindle.

* * * * *